United States Patent [19]

Shu

[11] Patent Number: 4,474,237

[45] Date of Patent: Oct. 2, 1984

[54] METHOD FOR INITIATING AN OXYGEN DRIVEN IN-SITU COMBUSTION PROCESS

[75] Inventor: Winston R. Shu, Dallas, Tex.

[73] Assignee: Mobil Oil Corporation, New York, N.Y.

[21] Appl. No.: 559,138

[22] Filed: Dec. 7, 1983

[51] Int. Cl.[3] ..... E21B 43/243; E21B 36/02

[52] U.S. Cl. ..... 166/261; 166/59; 166/242

[58] Field of Search ..... 166/260, 261, 272, 303, 166/59, 242

[56] References Cited

U.S. PATENT DOCUMENTS

| | | | |
|---|---|---|---|
| 2,630,307 | 3/1953 | Martin | 166/261 X |
| 2,877,847 | 3/1959 | Pelzer et al. | 166/261 |
| 2,985,240 | 5/1961 | Emery | 166/59 |
| 3,272,262 | 9/1966 | Hujsak | 166/261 |
| 3,420,300 | 1/1969 | Todd | 166/261 |
| 3,774,682 | 11/1973 | Bousaid et al. | 166/260 |
| 4,410,042 | 10/1983 | Shu | 166/261 |
| 4,415,031 | 11/1983 | Hunt | 166/261 |
| 4,427,066 | 1/1984 | Cook | 166/261 |
| 4,436,153 | 3/1984 | Carlson | 166/260 |
| 4,440,227 | 4/1984 | Holmes | 166/261 |

*Primary Examiner*—George A. Suchfield

*Attorney, Agent, or Firm*—Alexander J. McKillop; Michael G. Gilman; Malcolm D. Keen

[57] ABSTRACT

A method for initiating an in-situ combustion process for the recovery of oil from a subterranean, viscous oil-containing formation wherein a combustible gas such as natural gas or methane and a mixture of oxygen and carbon dioxide containing 55 to 80 volume percent carbon dioxide is injected into a downhole burner in the injection well and ignited to produce combustion gases containing heat energy that pass into the formation. After the area of the formation surrounding the injection well reaches a temperature within the range of 500° to 800° F., injection of the combustible gas is terminated and injection of the mixture of oxygen and carbon dioxide is continued to initiate in-situ combustion in the formation. Thereafter, essentially pure oxygen is injected into the formation to support in-situ combustion in the formation for the recovery of oil therefrom. Alternatively, after the combustion front has been formed, injection of the mixture of oxygen and carbon dioxide containing 55 to 80 volume percent carbon dioxide is continued until the combustion front has moved at least 30 feet into the formation before essentially pure oxygen is injected.

8 Claims, 1 Drawing Figure

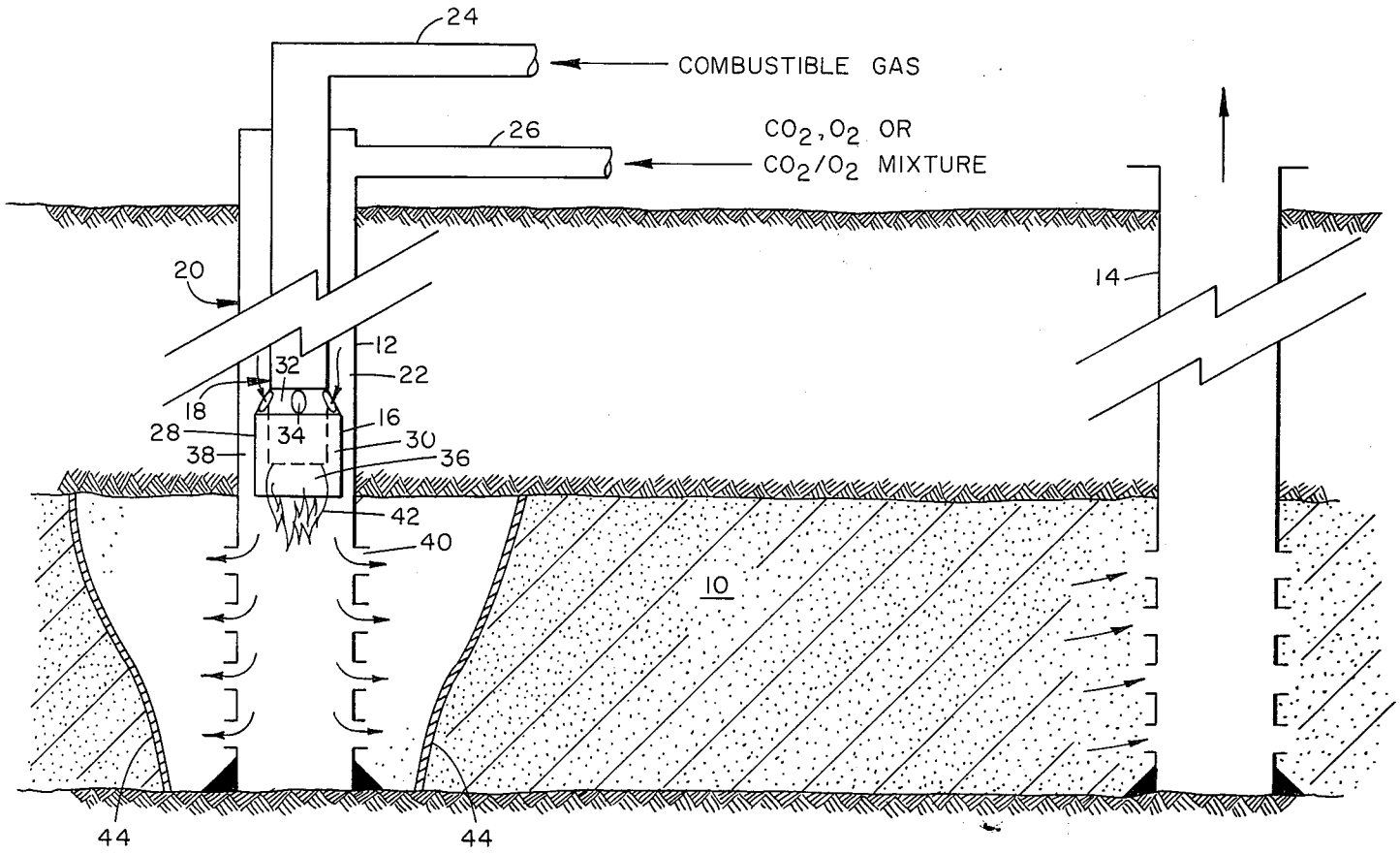
COMBUSTIBLE GAS
$CO_2$, $O_2$ OR
$CO_2/O_2$ MIXTURE
24
26
14
10
12
22
16
30
36
42
40
32
34
18
28
38
20
44
44

METHOD FOR INITIATING AN OXYGEN DRIVEN IN-SITU COMBUSTION PROCESS

BACKGROUND OF THE INVENTION

This invention relates to a method for initiating an in-situ combustion process to recover energy raw materials such as petroleum hydrocarbons from a subterranean formation by the introduction of oxygen into the formation.

Since the invention of the in-situ combustion method for petroleum recovery by F. A. Howard in 1923, a number of methods have been developed, the object of which is the production of heat within the reservoir, especially of sufficient heat, by means of partial combustion of oil residues in a petroleum reservoir to enable recovery of the remaining oil. The most important mechanisms contributing to enhanced recovery are viscosity reduction by means of heat, distillation and cracking of the oil and of the higher boiling components, sweeping out of the oil with hot water and extraction of the oil by means of miscible products.

The use of high purity oxygen in place of air significantly improves the performance of the in-situ combustion process. One of the disadvantages of the use of oxygen is its hazardous nature that could lead to uncontrolled reactions or explosions. Because of the hazardous nature of pure oxygen in reacting with other materials much work has been done to reduce this danger. In addition to the question of reaction of oxygen with various materials, the dynamics of compressible fluids is also an important factor in determining what hazard exists when a material is reacted with oxygen.

It is known from experience in autogenous gas cutting that not only the nature of the material but also the composition of the gas used has an influence of the material's cutting quality. With an oxygen content of less than 95%, steel can still be ignited but combustion is not self-sustaining. These ratios apply to atmospheric pressure. In one series of tests, Hvizdos et al, (*Journal of Petroleum Technology*, June 1983, pp. 1061–1070), reported that samples of carbon steel with a geometry similar to the tubing used in injection wells were tested. The results of Hvizdos et al show that oxygen concentration and pressure have a dramatic effect on flame propagation. For instance, it was found that the tubing, once ignited, would not continue to burn if the oxygen concentration was below a critical level but that the flame would propagate if the oxygen concentration was over that level. The critical level of oxygen concentration is a function of pressure, illustrating that data at low pressure should not be used to plan projects which will operate at high pressure. For safety, a low limit of 45% oxygen should be used for a wide-range of pressures.

Great importance is accordingly attached to the structure of the spaces in which the oxygen is flowing. Should said spaces possess a large inner surface in relation to the volume, then the danger of an explosion when a fuel and oxygen are reacted is greatly reduced. Consequently the reaction of oxygen with oil contained in the pores of the reservoir rocks poses relatively few problems. However, given certain geometric proportions of the spaces through which the oxygen flows, local temperature peaks can occur and cause ignition of the material (steel, plastic, wood, etc.). It follows that the most dangerous point along the oxygen's flow path is the borehole. The operating conditions in a petroleum borehole are such that when high percentage oxygen is introduced there is a great danger of an explosion in the borehole. Neither is the borehole equipment made from deflagration-proof material (copper, Inconel) nor is the condition of the equipment, due to contact with corrosive, erosive and organic agents, such that the danger is lessened.

The injection of oxygen into a wellbore presents significant hazards and requires safety precautions. Previous work in this regard includes the injection of $O_2$ through a bottom water zone, as disclosed in U.S. Pat. No. 3,208,519 by T. V. Moore, and the initiation of combustion with air followed by oxygen as disclosed in U.S. Pat. No. 4,042,026 by G. Pusch et al. All these methods use air to establish gas flow. However, it has been found that injection of air increases the viscosity of the oil by 100 times when the oil is contacted by air for two days. This increase in viscosity is detrimental to the recovery process.

U.S. Pat. No. 1,410,042 to Shu discloses an in-situ combustion operation wherein a mixture of oxygen and carbon dioxide is injected into the formation to initiate combustion followed by injection of oxygen.

It is therefore the objective of this invention to eliminate these risks or at least reduce them to an acceptable level within the framework of conventional equipment used in boreholes for the recovery of energy raw materials such as petroleum hydrocarbons.

SUMMARY

The present invention relates to a method for initiating an in-situ combustion operation in a process for the recovery of oil from a subterranean, viscous oil-containing formation penetrated by an injection well and a spaced-apart production well comprising the steps of assembling a downhole burner in the injection well near the top of the formation, introducing a combustible gas such as methane or natural gas and a mixture of oxygen and carbon dioxide containing 55 to 80 volume percent carbon dioxide into said downhole burner to produce a combustible mixture therein, igniting said combustible mixture to produce hot combustion gases containing heat energy that passes into the formation adjacent said injection well, continuing injection of said combustible gas and said mixture of oxygen and carbon dioxide until the temperature of the area of the formation surrounding the injection well is within the range of 500° to 800° F. Thereafter injection of the combustible gas is terminated and injection of the mixture of oxygen and carbon dioxide containing 55 to 80 volume percent carbon dioxide into the formation via the injection well is continued to initiate in-situ combustion in the formation and form a combustion front therein. After formation of the combustion front or after the combustion front has advanced at least 30 feet into the formation, injection of the mixture of oxygen and carbon dioxide is terminated and thereafter essentially pure oxygen is injected into the formation via the injection well to support in-situ combustion.

BRIEF DESCRIPTION OF THE DRAWING

The accompanying drawing illustrates the method used in the invention for initiation of an in-situ combustion operation to recover oil from a subterranean formation.

DESCRIPTION OF THE PREFERRED EMBODIMENT

Referring to the drawing, there is shown a subterranean, viscous oil-containing formation 10 such as a heavy oil or tar sand deposit penetrated by an injection well 12 and at least one spaced-apart production well 14. Injection well 12 and production well 14 are perforated or other fluid flow communication is established between the wells and a substantial portion of the vertical thickness of the formation 10. While recovery of the type contemplated by the present invention may be carried out by employing only two wells, it is to be understood that the invention is not limited to any particular number of wells. The invention may be practiced using a variety of well patterns as is well known in the art of oil recovery, such as an inverted five spot pattern in which an injection well is surrounded with four production wells, or in a line drive arrangement in which a series of aligned injection wells and a series of aligned production wells are utilized. Any number of wells which may be arranged according to any pattern may be applied in using the present method as illustrated in U.S. Pat. No. 3,927,716 to Burdyn et al, the disclosure of which is hereby incorporated by reference. Either naturally occuring or artifically induced fluid communication should exist between the injection well 12 and the production well 14. Fluid communication can be induced by injection of carbon dioxide, a solvent or steam. Fracturing may also be employed to improve the transmissibility of the formation using procedures well known in the art.

A gas fired burner, denoted generally by the reference numeral 16 is contained within injection well 12 and positioned just above the oil-containing formation 10. Referring to the drawing, the burner 16 which takes the general shape of an inverted Bunsen burner comprises tubing 18 disposed and centered within well casing 20 to form annular chamber 22 between said tubing and said casing, said tubing 18 being open at its downstream end. The upstream or upper end of tubing 18 located on the surface is in communication with conduit 24 connected to a source of a combustible gas such as natural gas or methane. Conduit 26 located on the surface is connected to a source of oxygen and carbon dioxide and is in communication with annular space 22. Said burner 16 comprises a flame tube 28 disposed concentrically around tubing 18 to form an annular chamber 30 around said tubing and between said tubing and said flame tube. Said flame tube 28 is open at its downstream end which extends beyond the downstream end of tubing 18 to a position near the upper portion of the formation 10. An annular connecting section 32 tapers in increasing cross-sectional area from a point above the lower end of tubing 18 to the upstream end of flame tube 28. A plurality of openings 34 are provided in the wall of said connecting section 32 for admitting a portion of the combustion-supporting gas from annular chamber 22 into annular chamber 30 and is then mixed with fuel emerging from the end of tubing 18 to form a combustible mixture in combustion zone 36. Flame tube 28 centered in well casing 20 forms an annular chamber 38 around said flame tube, and between said flame tube and said well casing. Both the well casing 20, tubing 18 and flame tube 28 of the injection well 12 are made of carbon steel commonly used in oil fields.

If it is determined that the formation 10 does not possess naturally occuring permeability to fluids, carbon dioxide is injected into the formation via conduit 26, annulus 22, and through perforations 40 of injection well 12 for a period of time sufficient to establish fluid communication between the injection well 12 and the production well 14.

Thereafter, a combustible gas such as methane or natural gas is supplied to combustion zone 36 via conduit 24 and tubing 18. A mixture of oxygen and carbon dioxide containing 55 to 80 volume percent carbon dioxide is passed via conduit 26 down through annular chamber 22. A portion of the mixture of oxygen and carbon dioxide in annulus 22 passes into combustion zone 36 via openings 34 and annulus 30 to form a combustible mixture with the gas emerging from the end of tubing 18. A small amount of a pyrophoric material is lowered down tubing 18 to ignite the combustible mixture in combustion zone 36 and produce hot combustion gases 42 containing heat energy. A thermocouple (not shown) is positioned in burner 16 for detecting ignition of the combustible mixture. That portion of the oxygen and carbon dioxide that does not pass through openings 34 from annulus 22 passes through annulus 38 and mixes with combustion gases emerging from the end of flame tube 28 thereby becoming hot. The hot combustion gases and heated excess mixture of oxygen and carbon dioxide from annulus 38 pass into the formation 10 via perforations 40 to heat the formation, and combustion in burner 16 is continued until the temperature of the area of the formation surrounding the injection well 12 is within the range of 500° to 800° F. Thereafter injection of the combustion gas is terminated and injection of the mixture of oxygen and carbon dioxide containing 55 to 80 volume percentage carbon dioxide is continued to spontaneously initiate in-situ combustion in the formation 10 and form a combustion front 44. The use of a gaseous mixture containing not more than 80 volume percent carbon dioxide does not interfere with initiation of in-situ combustion while using not less than 55 volume percent carbon dioxide (or no more than 45 volume percent oxygen) prevents flame propagation in the case of a downhole tubing fire.

Once the combustion front 44 is formed in the formation 10, or after sufficient oxygen and carbon dioxide have been injected to advance the combustion front away from the injection well 12 a predetermined distance, preferably at least 30 feet, injection of the mixture of $O_2/CO_2$ is terminated and thereafter essentially pure oxygen is injected into the formation via the injection well to support combustion, and fluids including oil are recovered from the formation via the production well 14. In another embodiment, after in-situ combustion has been initiated or after the combustion front has advanced away from the injection well a distance of at least 30 feet, the oxygen concentration of the injected $O_2/CO_2$ mixture is gradually increased at a controlled rate until the gas being injected is essentially pure oxygen. Advancing the combustion front 44 away from the injection well 12 before injecting essentially pure oxygen into the formation 10 ensures that there is no hydrocarbon residue near the injection well to come into contact with a gas containing more than 45 volume percent oxygen that could cause a downhole fire or explosion.

The use of a mixture of oxygen and carbon dioxide as the combustion-supporting gas to initiate in-situ combustion does not promote degradation in oil viscosity due to oxidation as is the case with mixture of oxygen and nitrogen as disclosed in prior arts. In the present process, any increase in oil viscosity due to oxidation is more than offset by a reduction in viscosity due to carbon dioxide dissolution. For example, an Athabasca bitumen with a viscosity of 50,000 cp at 104° F. will have a reduction in viscosity by 1000 times, when saturated with carbon dioxide at 600 psia (see Jacobs, F.A., et al, *J. Can. Pet. Tech.*, Oct.-Dec., 1980, pp. 46–50). In the latter example, it is disclosed that it requires only 200 scf of carbon dioxide to saturate a barrel of oil at 600 psia. Assuming the oil saturation is 100 bbls/ac-ft, it requires only $0.2\times10^6$ scf/ac-ft of carbon dioxide to saturate the oil. After in-situ combustion has been initiated, there is a sufficient amount of carbon dioxide generated in-situ to saturate the oil in the formation so there is no need to continuously inject carbon dioxide during the combustion process. It is noted that the dissolution of the carbon dioxide in the oil reduces the free gas in the reservoir and increases effective oil permeability. In addition, carbon dioxide has a nice fire-extinguishing characteristic which can be conveniently applied in the case of an accidental wellbore ignition.

The oxygen and carbon dioxide may both be stored in liquid form near the injection well or wells. Both materials may be more conveniently pumped in liquid form from separate storage tanks into a vaporizer and then injected into the injection well. The compositon of the oxygen/carbon dioxide mixture supplied to the injection well is controlled by sensing and controlling the flow rates of the individual oxygen and carbon dioxide streams by means of a flow controller.

What is claimed is:

1. A method for initiating an in-situ combustion operation in a process for the recovery of oil from a subterranean, viscous oil-containing formation penetrated by an injection well and a spaced-apart production well comprising the steps of:

(a) assembling a downhole burner having a combustion section in the injection well located near the formation;

(b) introducing a combustible gas and a mixture of oxygen and carbon dioxide containing 55 to 80 volume percent carbon dioxide into the combustion section of said downhole burner to produce a combustible mixture therein;

(c) igniting said combustible mixture to produce hot combustion gases containing heat energy that passes into the formation adjacent said injection well;

(d) continuing injection of said combustible gas and mixture of oxygen and carbon dioxide until the temperature of the area of the formation surrounding the injection well is within the range of 500° to 800° F.;

(e) thereafter terminating the injection of the combustible gas and continuing to inject the mixture of oxygen and carbon dioxide containing 55 to 80 volume percent carbon dioxide into the formation via the injection well to initiate in-situ combustion in the formation and form a combustion front; and (f) terminating injection of the mixture of oxygen and carbon dioxide and thereafter injecting essentially pure oxygen into the formation via the injection to support in-situ combustion in the formation.

2. The method of claim 1 wherein said combustible gas is natural gas.

3. The method of claim 1 wherein said combustible gas is methane.

4. The method of claim 1 further including the step of continuing injection of said mixture of oxygen and carbon dioxide during step (e) until the combustion front has moved a predetermined distance into said formation.

5. The method of claim 4 wherein the combustion front has moved a distance of at least 30 feet into the formation from the injection well.

6. The method of claim 1 further including increasing the oxygen concentration of the injected mixture of oxygen and carbon dioxide following step (e) until the injected gas comprises essentially pure oxygen.

7. The method of claim 1 wherein said downhole burner is formed from an elongated vertical combustion chamber means open at both ends, having both combustible gas supply and oxygen/carbon dioxide mixture supply conduits connected thereto for mixing the combustible gas and mixture of oxygen and carbon dioxide in the combustion chamber.

8. The method of claim 1 wherein the tubing and casing of the injection well comprises carbon steel.

* * * * *